United States Patent [19]

Haynes

[11] 4,202,501

[45] May 13, 1980

[54] CONSTANT VOLUME AERATED SHOWERHEAD APPARATUS

[76] Inventor: Kenneth H. Haynes, 1241-H E. Chestnut St., Santa Ana, Calif. 92701

[21] Appl. No.: 889,228

[22] Filed: Mar. 23, 1978

[51] Int. Cl.[2] ..... B05B 1/18; B05B 1/30

[52] U.S. Cl. ..... 239/570; 239/428.5; 239/553.3; 138/45

[58] Field of Search ..... 239/428.5, 553.3, 562, 239/570, 571, 590.3; 138/45

[56] References Cited

U.S. PATENT DOCUMENTS 2,680,043 6/1954 Campbell ..... 239/570 X

*Primary Examiner*—Robert W. Saifer

*Attorney, Agent, or Firm*—H. Gordon Shields

[57] ABSTRACT

Showerhead apparatus includes a deformable washer and a metering orifice to provide a substantially constant flow of aerated water over a wide range of pressures of the water supply line.

8 Claims, 5 Drawing Figures

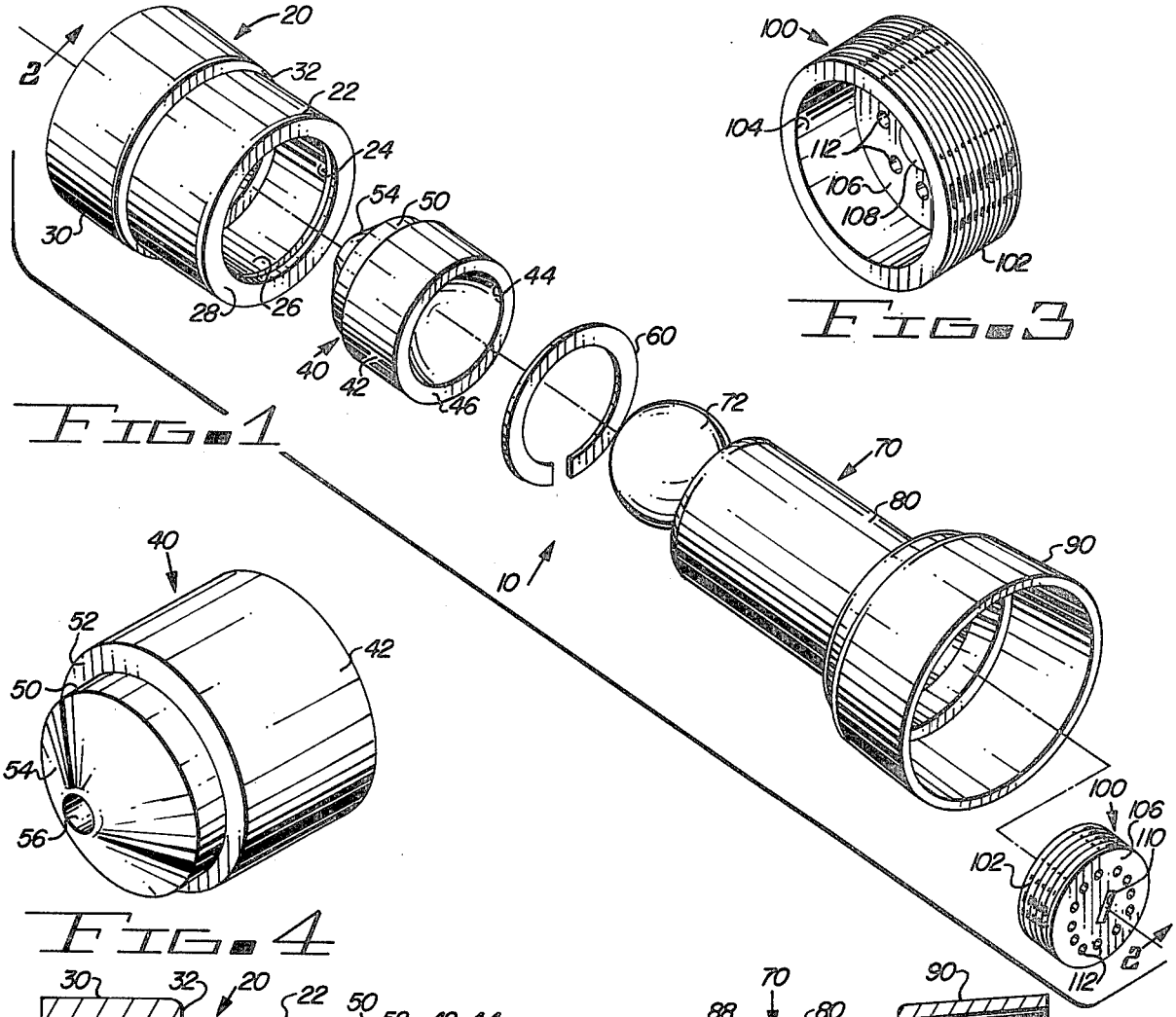
FIG. 1
FIG. 3
FIG. 4
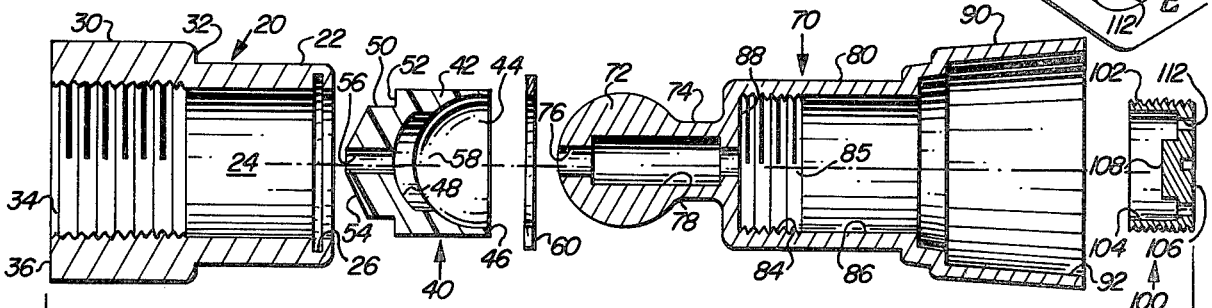
FIG. 2
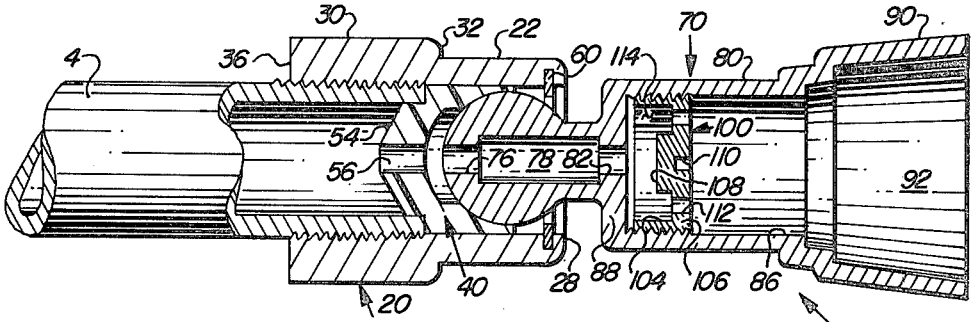
FIG. 5

CONSTANT VOLUME AERATED SHOWERHEAD APPARATUS

BACKGROUND OF THE INVENTION

1. Field of the Invention

This invention relates to showerhead apparatus, and more particularly, to showerhead apparatus which provides a substantially constant flow of water from the apparatus generally without regard to the input pressure of the water supply to which the showerhead apparatus is connected.

2.Description of the Prior Art

With water shortages facing criticality in many parts of the world, including portions of the United States at various times, the conservation of water has become of paramount importance.

One prior art method for reducing the output of showers is to use an orifice of a fixed size. Another method is to limit the pressure of the water flowing out of the showerhead. Neither method is entirely satisfactory since neither produces a substantially constant output.

Another way in which to conserve water is to provide a showerhead which limits or controls the flow of water through the showerhead virtually without regard to the pressure of the water supply to which the showerhead is secured. Thus, through a relatively wide range of water pressures, the flow of water in terms of gallons per minute from the showerhead apparatus is kept relatively constant. Such apparatus is disclosed in my copending application, Ser. No. 738,335, now U.S. Pat. No. 4,082,225, issued Apr. 4, 1978. The apparatus of the present invention is substantially simpler with fewer parts than the apparatus disclosed in my previous application, but the net results are substantially the same. It will be noted that the apparatus of the present invention includes an aerator for mixing the water output with air to provide an aerated output or water flow, with its overall effect on the person taking a shower of providing the feeling of more water than is actually provided.

The apparatus of the prior art, as embodied in my copending application, provides a relatively constant output by means of a control sleeve which includes slots, communicating with the water supply, of a total area which decreases with an increase in the water pressure. The sleeve is spring biased to move against an increase in the water pressure to decrease the area of the slots available to the flow of water as the pressure of the water supply increases. Thus a maximum slot area is available to the water supply with a minimum amount of pressure. As the water pressure increases, the slot area decreases to provide a relatively constant water flow output in terms of gallons per minute. The disadvantage of the several parts, including moving parts, has been eliminated in the apparatus of the present invention.

SUMMARY OF THE INVENTION

The apparatus of the present invention comprises a showerhead including a deformable control washer which deforms in accordance with the pressure of the water supply and a metering orifice to provide a substantially constant output of water in terms of gallons per minute and the output water is aerated to provide, to the user, a constant volume of aerated water.

Among the objects of the present invention are the following:

To provide new and useful showerhead apparatus;

To provide new and useful constant volume showerhead apparatus;

To provide new and useful showerhead apparatus having an aerated water output;

To provide new and useful showerhead apparatus which delivers a constant volume of water over a wide range of water pressures of the water supply to which the apparatus is secured;

To provide new and useful showerhead apparatus having a deformable control washer; and To provide new and useful constant volume showerhead apparatus having a minimum number of parts.

BRIEF DESCRIPTION OF THE DRAWING

FIG. 1 is an exploded perspective view of showerhead apparatus of the present invention.

FIG. 2 is a view in partial section of the showerhead apparatus of FIG. 1 taken generally along line 2—2 of FIG. 1.

FIG. 3 is a perspective view of the portion of the apparatus of FIG. 1, comprising a rear view of the aerator element shown in FIGS. 1 and 2.

FIG. 4 is a perspective rear view of the control washer used in the present invention and illustrated in FIGS. 1 and 2.

FIG. 5 is a view in partial section showing the apparatus of the present invention assembled and secured to a water supply line.

DESCRIPTION OF THE PREFERRED EMBODIMENT

FIG. 1 is a perspective, exploded view of showerhead apparatus 10 embodying the present invention. FIG. 2 is a view in partial section of the showerhead apparatus of FIG. 1 taken generally along line 2—2 of FIG. 1. FIG. 2 comprises an exploded view in partial section of the showerhead apparatus of FIG. 1. The showerhead apparatus 10 is shown assembled in FIG. 5 and secured to a water supply pipe or nipple 4.

FIGS. 3 and 4 are perspective views of elements included in the apparatus of the present invention, illustrating features of the individual elements which are not clearly illustrated in FIGS. 1, 2, or 5. FIG. 3 is a perspective view of an aerator element 100, and FIG. 4 is a perspective view of a control washer 40. For an understanding of the apparatus, references will be made to FIGS. 1, 2, and 5 for the description of the showerhead apparatus and generally. Specific reference will be made to FIGS. 3 or 4 when discussing the individual elements shown in the figures.

The showerhead apparatus 10 includes a housing 20 which comprises a pair of cylindrical portions, including a forward cylinder 22 and a rear cylinder 30. The exterior diameter of the forward cylinder 22 is illustrated as being slightly less than the outside diameter of the rear cylinder 30. The forward cylinder includes a generally smooth bore 24 and the rear cylinder includes a threaded bore 34. The bores 24 and 34 are coaxial and are substantially the same diameter. The internally threaded bore 34 receives the exterior threads of the supply pipe or nipple 4, as illustrated in FIG. 5.

An exterior shoulder or step 32 is defined at the juncture of the cylindrical portions 22 and 30 of the housing 20. A forward face 28 is defined at the front or forward portion of the front cylinder 22. The face 28 is substantially perpendicular to the longitudinal axis of the housing 20, which longitudinal axis extends lengthwise to the center of the bores 24 and 34. A groove 26 extends about the inner periphery of the bore 24 spaced apart slightly rearwardly from the front face 28. The groove 26 is substantially perpendicular to the longitudinal axis of the housing 20 and accordingly substantially parallel to the front face 28. The groove 26 receives a "C" ring 60 which is used to secure the housing 20 to ball 72 of cone 70, as shown in FIG. 5.

The housing 20 also includes a rear face 36 which is substantially parallel to the front face 28. The rear face 36 is best sown in FIGS. 2 and 5.

A deformable control washer 40 is disposed in the bore 44 of the forward cylinder 22. The control washer regulates the flow of the water, as discussed below. The control washer 40 is illustrated as being in front of, or forward of, the housing 2j0 in FIGS. 1 and 2 for convenience since it is shown located closer to the bore 24 in which it is disposed. In actual assembly of the showerhead apparatus 10, the control washer 40 is inserted into the housing 20 through the threaded bore 34 because, with the threads, the bore 34 is slightly larger than the bore 24, and it is thus easier to insert the control washer 40 into the housing from the rear, or through the rear cylinder 30.

Various features of the control washer are shown in FIGS. 1, 2, 4, and 5. The control washer 40 includes a generally cylindrical front portion 42 and a relatively short rear cylindrical portion. An exterior step or shoulder 52 extends between the respective cylindrical portions 42 and 50. The front or forward face of the supply pipe or nipple 4 is disposed against the shoulder 52, as shown in FIG. 5, when the showerhead apparatus is secured to the water supply pipe or nipple. Thus the outer diameter of the rear cylindrical portion 50 is substantially the same as the inside diameter of a nominal one-half inch water supply pipe or nipple, which is customarily used in showers. Rearwardly of the rear cylindrical portion 50 is a conical portion 54. A central bore 56 extends through the conical portion 54 coaxially with respect to a pair of concave portions, including a forward concave portion or socket 44 and a rear concave portion 48. The rear concave portion 48 is separated from the forward concave portion or socket 44 by a relatively short interior bore 58, best illustrated in FIG. 2. The socket 44 receives the ball 72 and is dimensionally configured to allow the socket 72 to seat into the socket 44, as will be explained in detail below.

As shown in FIG. 5, the ball 72 is received in the socket 44, and the rear concave portion 48 serves as a chamber to provide communication between the bore 56 and the interior bore of the ball 72 regardless of the orientation of the ball with respect to the central bore 56 of the control washer 40. This allows the cone 70 to be generally aimed or directed at an angle with respect to the axis of the housing 20 and yet still provide a stream or flow of water through the showerhead apparatus without interference in any way between the bore 56 of the control washer 40 and the ball 72 of the cone 70.

The cone 70 includes three primary portions, a ball portion 72, a cylinder portion 80, and a conical portion or exit cone 90. Between the ball 72 and the cylinder 80 is a connector or neck 74.

The ball 72 is substantially spherical except for the neck 74 which joins the cylinder 80. The ball 72, cylinder 80, and conical portion or exit cone 90 are coaxially aligned. A bore or metering orifice 76 extends coaxially into the ball. The bore or metering orifice generally helps to control the flow of water by reducing the amount of water flowing through the apparatus, and, with the control washer 40, provides a substantially constant volume output. Within the ball is a second bore or collector 78. The bores 76 and 78 are, of course, coaxially aligned. The bore or collector 78 is substantially larger in diameter than is the metering orifice or bore 76. The collector bore 78 extends through the ball 72 and through the neck 74, and terminates at an entry bore 82.

The collector bore is disposed between the metering orifice 76 and an entry bore or orifice 82 which opens into the cylinder portion 80 of the cone 70. The metering orifice 76 and the entry orifice 82 are substantially the same diameter, while the collector bore is shown as having a larger diameter. All three bores are, of course, coaxially aligned. If desired, and such may be desired for a metal cone 70, all three bores may be of the same diameter, thus comprising only a single metering bore. However, the embodiment illustrated may be preferable when the apparatus is fabricated out of a plastic material to equalize the structural strength of the apparatus.

When assembled, as shown in FIG. 5, the ball 72 fits into the socket 44 and is held in the socket 44 of the control washer 40 by the "C" ring 60. The internal diameter of the C ring 60, when the C ring is in its normal configuration, is less than the external diameter of the ball 72. However, the C ring is expanded to receive the ball 72, and the ball is then inserted into the socket 44 of the control washer 40. The C ring is then reduced in diameter and inserted into the groove 26 of the housing 20 to secure the cone 70 to the housing 20.

To assemble the showerhead apparatus 10 to a water supply pipe 4, as shown in FIG. 5, the interior threaded portion 34 of the housing 20 threadedly engages the external threads of the supply pipe 4. The end of the supply pipe 4 is received against the exterior shoulder 52 of the control washer 40 to insure a water-tight fit of the control washer against the ball 72. In turn, the ball 72 is pressed against the C ring 60 to maintain the orientation of the cone 70 with respect to the housing 20. As is obvious, the cone 70 may be moved relative to the housing 20 to aim the exit cone 90 as desired by the user. However, depending on how tightly the housing 20 is secured to a water supply pipe 4, the housing may require a slight loosening in order to move the cone 70 relative to the housing. The housing may then be again tightened against the supply pipe 4.

As is apparent from FIG. 5, the control washer 40 also serves as a gasket or seal between the supply pipe 4 and the housing 20. The pressure of the end of the supply pipe 4 against the shoulder 52 of the control washer, together with the threaded engagement between the housing 20 and the supply pipe 4, serves to compress and hold tightly the control washer against both the supply pipe and the housing to insure that there is a water-tight connection and that no leakage occurs.

Internally of the cylindrical portion 80 of the cone 70 is a threaded bore 84. The threaded bore 84 is disposed adjacent an end wall 88 of the cylinder 80 and adjacent the ball portion 72 of the cone 70. The entry bore 82 extends from the collector bore 78 into the threaded bore 84. A bubble generator 100 is disposed on the threaded bore 84. Internal threads 85 are disposed within the bore 84.

The bubble generator 100 is generally cylindrical in configuration, and it includes threads 102 on its external periphery. The external threads 102 threadedly engage the internal threads 85 within the bore 84 of the cylinder 80 of the cone 70. Within the bubble generator 100 is a bore 104. The bore 104 is open towards the end wall 88 of the cylinder 80, and its other end is closed by an end wall 106. The end wall 106 includes a raised central boss portion 108 which projects or extends into the bore 104. The boss 108 is centrally disposed, or coaxially aligned with respect to the bore 104 of the bubble generator 100 and also coaxially aligned with respect to the entry bore 82 in the end wall 88 of the cylinder 80. A slot 110 extends into the end wall 106 remote from the boss 108. The slot 10 is used in the insertion and removal of the bubble generator from the threaded bore 84. The slot 110 accordingly is designed to receive the blade of a screwdriver for rotation of the bubble generator 100 relative to the cone 70. Obviously, the relative rotation of the bubble generator with respect to the cone 80 results in an engagement or disengagement between the threads 85 and the threads 102 of the cone 80 and the bubble generator 100, respectively.

Disposed concentrically about the boss 108 and extending through the end wall 106 are a plurality of holes or apertures 112 disposed adjacent the periphery of the end wall.

The operation of the bubble generator may be understood in reference to FIG. 5. Water flowing from the supply pipe 4 through the bore 56 of the control washer 40 flows also through the metering orifice 76 of the ball 70 and into the collector 78. From the collector 78 the water flows through the entry bore 82 and is directed against the boss 108 which is directly opposite the bore 82. The water bounces off the boss 108 into a cavity or chamber 114 defined between the end wall 88 of the cylindrical portion 80 and the end wall 106, and thus includes the bore 104 of the bubblle generator 100. When the water bounces off the boss 108 and into the cavity or chamber 114, air is drawn into the bore 104 and the cavity 114 through the apertures 112. The air mixes with the water and the water and air mixture then flows outwardly from the cavity 114 and bore 104 into the bore 86 of the housing 70 and outwardly through the exit cone 90. The combination air and water thus provides the same feeling and effect to a user of the showerhead apparatus as does a larger quantity of water, say from a conventional showerhead. However, the actual quantity or volume of water emanating from the showerhead is substantially less than that of a conventional showerhead. The constant volume showerhead apparatus 10 thus produces the same effect to a user as does a conventional showerhead, but with a substantial savings in the amount of water actually used.

Water flowing through the supply pipe 4 is directed against the conical portion 54 of the control washer 40 and through the bore 56 of the control washer. The control washer, being deformable, deforms from the conical portion inwardly to reduce the diameter of the bore 56 in accordance with the increase in the water pressure impinging on the conical surface 54. That is, as the pressure of the water impinging on the conical portion 54 of the control washer 40 increases, the control washer deforms to reduce the diameter of the bore 56. As the diameter of the bore 56 decreases, the flow of water through the bore is held relatively constant due to the increase in the pressure. Thus the same general quantity of water flows through the bore 56 substantially without regard to the pressure of the water supply by varying the diameter of the bore 56. As the water pressure against the control washer decreases, the control washer returns to its original configuration, and to the original diameter of the bore 56, in accordance with the lessening of the pressure until the bore 56 assumes its original, maximum diameter. The volume of the water flowing through the bore 56 is dependent primarily upon two variables, one variable being the pressure of the water supply and the second variable being the diameter of the bore 56. A third factor, a constant, the metering orifice or bore 76, is also present to aid and cooperate in providing a substantially constant volume of water from the apparatus.

With a predetermined volume of water in terms of gallons per minute desired to flow from the showerhead apparatus, the deformation of the control washer, and accordingly the diameter of the bore 56, is predetermined to vary in accordance with the pressure of the water supply flowing through the water supply pipe 4. That is, the original dimensions of the bore 56, the bore or orifice 76, and the deformation of the control washer 40 to reduce the diameter of the bore 56 are predetermined in accordance with the desired water flow. The net result is a substantially constant volume of water flowing through the showerhead apparatus.

For example, with a desired or predetermined flow rate of less than two gallons per minute, and an input or supply pressure for the water varying from about twenty P.S.I. to about sixty or seventy P.S.I. or more, a "neoprene" rubber control washer 40 may have a bore 56 with a maximum or unstressed diameter of about three thirty-seconds (3/32) of an inch, and a metering orifice or bore 76 diameter of also about three thirty-seconds (3/32) of an inch. The diameter of the apertures 112 of the bubble generator 100 may typically be about forty one-thousandths (0.040) of an inch, and there may be about twelve such apertures.

As discussed in detail above, the water through the bore 56 flows into the rear concave portion 48 of the control washer which defines a cavity which communicates with the bore or metering orifice 76 of the ball 70. The ball 70 is in turn disposed in the socket 44 of the control washer 40. The flow of water is thus from the bore 56 into the concave portion or chamber 48, through the orifice 76 into the collector bore 78 of the ball 72, and through the bore 82 and into the bore 104 of the bubble generator 100. From the cavity or chamber of the bubble generator, the water and air flows through the apertures or holes 112 and out through the bore 86 and the conical exit bore 92 to the user of the showerhead apparatus.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What is claimed is:

1. Showerhead apparatus for providing a substantially constant output flow of water over a wide range of input water supply pressures, comprising, in combination:

housing means, including a first portion, means for securing the first portion to a supply of water, and a first bore in the housing means;

control washer means disposed in the first bore and deformable in response to the pressure of the supply of water through the control washer means, including a second bore through which the water flows, a conical face tapering away from the second bore on which the flow of water impinges from the first bore of the housing means, and a first concave portion communicating with the second bore remote from the conical face into which the water flows from the second bore;

a metering orifice communicating with the first concave portion for receiving the flow of water from the second bore of the deformable control washer means, a third bore communicating with the metering orifice and coaxially aligned with the metering orifice for receiving the flow of water from the metering orifice, and a fourth bore through which the water flows out of the apparatus.

2. The apparatus of claim 1 in which the second bore of the control washer means varies in diameter in response to the deformation of the control washer means by the pressure of the supply of water against the conical face.

3. The apparatus of claim 2 in which the housing means further includes a second portion, and the metering orifice and the third and fourth bores are disposed in the second portion.

4. The apparatus of claim 3 in which the second portion of the housing means further includes a ball, and the control washer means includes a second concave portion for receiving the ball of the second portion of the housing means.

5. The apparatus of claim 4 in which the metering orifice is disposed in the ball of the second portion of the housing means.

6. The apparatus of claim 3 in which the housing means further includes means for aerating the flow of water out of the fourth bore.

7. The apparatus of claim 6 in which the means for aerating the flow of water out of the fourth bore includes:

a fifth bore communicating with the third bore for receiving the flow of water from the third bore;

a first end wall in the fifth bore, an orifice in the first end wall through which the water flows into the fifth bore from the third bore, a second end wall in the fifth bore, spaced apart from the first end wall, against which the water flows, and a plurality of apertures in the second end wall spaced apart from each other and communicating with the third bore through which air and water flow.

8. The apparatus of claim 7 in which the second end wall includes a central boss and a plurality of apertures are disposed concentrically about the central boss.

* * * * *